US007040352B2

(12) United States Patent
Dagois et al.

(10) Patent No.: US 7,040,352 B2
(45) Date of Patent: May 9, 2006

(54) WEAVE SYSTEM OF JACQUARD TYPE, WEAVING LOOM EQUIPPED WITH SUCH A SYSTEM AND METHODS FOR ASSEMBLY AND DISMANTLING OF SUCH A SYSTEM

(75) Inventors: Claude Dagois, Annecy-le-Vieux (FR); Patrick Iltis, Saint Jorioz (FR)

(73) Assignee: Staubli Faverges, Faverges (FR)

( * ) Notice: Subject to any disclaimer, the term of this patent is extended or adjusted under 35 U.S.C. 154(b) by 0 days.

(21) Appl. No.: 10/874,576

(22) Filed: Jun. 24, 2004

(65) Prior Publication Data

US 2004/0261882 A1 Dec. 30, 2004

(30) Foreign Application Priority Data

Jun. 30, 2003 (FR) ..... 03 07895

(51) Int. Cl.
*D03C 3/00* (2006.01)

(52) U.S. Cl. ..... 139/59

(58) Field of Classification Search ..... 139/55.1, 139/35, 59, 65, 62.1, 61.1, 455.1
See application file for complete search history.

(56) References Cited

U.S. PATENT DOCUMENTS 6,050,305 A * 4/2000 Braun et al. ..... 139/455
6,105,629 A * 8/2000 Bourgeaux et al. ..... 139/455
6,216,750 B1 4/2001 Braun et al.

FOREIGN PATENT DOCUMENTS

FR 2772792 12/1997
FR 2794140 5/1999

* cited by examiner

*Primary Examiner*—John J. Calvert
*Assistant Examiner*—Andrew W. Sutton
(74) *Attorney, Agent, or Firm*—Dowell & Dowell, P.C.

(57) ABSTRACT

A weave system comprises a plurality of electric rotary actuators each of which is adapted to drive a pulley for winding a cord element controlling the position of at least one heddle, and wherein a removable cover is provided to isolate and protect a group of pulleys mounted on adjacent actuators. The cover is provided with means for releasably retaining at least one pulley in a position allowing it to be assembled on a corresponding actuator or dismantled with respect thereto as the cover is moved toward or away from a mounting position over the corresponding actuator and which releases the at least one pulley to freely rotate within the cover when the cover is completely seated in mounted relationship with respect to the actuators.

13 Claims, 4 Drawing Sheets

WEAVE SYSTEM OF JACQUARD TYPE, WEAVING LOOM EQUIPPED WITH SUCH A SYSTEM AND METHODS FOR ASSEMBLY AND DISMANTLING OF SUCH A SYSTEM

BACKGROUND OF THE INVENTION

1. Field of the Invention

The invention relates to a weave system of Jacquard type as well as to a weaving loom equipped with such a system. The invention also relates to methods for assembly and dismantling of such a system.

2. Brief Description of the Related Art

It is known, for example from FR-A-2 772 792, to use a rotary motor such as a step-by-step motor or a servo-motor in order to linearly control a cord from which a heddle of a weaving loom is suspended. According to this prior art, different actuators may be disposed in a casing, the pulleys driven by each actuator being protected by a cover allowing them to be isolated, particularly against the flock of the ambient atmosphere.

It is known that a very large number of such actuators may be provided in a weaving loom of Jacquard type, in which case panel structures may be used, as described in FR-A-2 794 140.

When the number of electric actuators is high, for example of the order of 10 000, an equally large number of pulleys must be mounted on these actuators in order to allow the corresponding cords to be wound. Such an operation is long and tedious and requires qualified manpower, in order to respect the order of assembly of the pulleys and in order not to damage the pulleys or the ends of the output shafts of the actuators on which they must be mounted.

SUMMARY OF THE INVENTION

It is a more particular object of the invention to overcome these limitations by proposing a weave system in which the assembly of the different winding pulleys may be effected conveniently and rapidly.

In this spirit, the invention relates to a weave system of the Jacquard type for forming the shed on a weaving loom, this system comprising a plurality of electric rotary actuators adapted each to drive in rotation a pulley for winding a cord element controlling the position of at least one heddle, while a cover is provided to isolate from the outside and/or protect a group of pulleys mounted on adjacent actuators. This system is characterized in that this cover is provided with means for retaining at least one pulley in a position allowing its assembly on the corresponding actuator or its dismantling with respect thereto.

Thanks to the invention, the positioning of the cover opposite the actuators, particularly on a casing in which actuators are mounted, allows the pulley or pulleys that it bears to be placed in position simultaneously.

According to advantageous aspects, a weave system may incorporate one or more of the following characteristics:

The retaining means are adapted to retain a plurality of pulleys in position of assembly/dismantling and are compatible with a simultaneous assembly/dismantling of these pulleys on the corresponding actuators. In other words, the retaining means make it possible to assemble a plurality of pulleys at the same time, hence a still more significant saving of time.

The retaining means are adapted to impose the angular orientation of the or each pulley, this making it possible to envisage an adjustment by default of the position of this pulley.

The retaining means comprise at least one elastically deformable tab defining with a corresponding member a zone for receiving a part of a pulley. In that case, this tab and this member are advantageously provided with elements in relief adapted to cooperate with elements in relief of corresponding shapes provided on the pulley, the cooperation of these elements in relief inducing an elastic catching of the pulley between the afore-mentioned tab and member. In addition, this tab and this member may define, with a bottom web of the cover, a zone for blocking a part of the pulley, such a zone being able to be used to firmly catch a pulley on the cover with a view to separating this pulley and the actuator on which it was previously mounted.

The cover bears, in the vicinity of the afore-mentioned retaining means, at least one element in relief adapted to cooperate with an element in relief of corresponding shape provided on the pulley, the cooperation of these elements in relief inducing a control of the angular orientation of the pulley about its central axis.

The cover is provided, in the vicinity of the afore-mentioned retaining means, with a housing for receiving the pulley without contact, this pulley being able to be displaced with respect to the cover between a first position in mesh with the retaining means and a second position disengaged from the retaining means and in which the pulley is in place in this housing, and vice versa, this displacement taking place thanks to a localised elastic deformation of the retaining means. The cover may be provided to be mobile with respect to a casing in which the actuators are mounted, in translation in a direction perpendicular to the axes of rotation of the output shafts of these actuators, between two positions in which the pulleys mounted on the actuators are either in the first position or in the second position mentioned above.

The invention also relates to a weaving loom equipped with a weave system as described hereinbefore. Such a weaving loom is more economical, easier to install and to maintain than those of the state of the art.

The invention also relates to a method for assembly of a weave system as described hereinabove and, more specifically, to a method which comprises steps consisting in:

mounting at least one pulley on a cover for isolating and/or protecting the electric rotary actuators of the system;

bringing the cover and the actuators closer to one another by a movement of translation in a direction substantially parallel to the axes of rotation of the output shafts of these actuators;

connecting the pulley to the output shaft of the corresponding actuator at the end of the afore-mentioned movement of approach, and displacing the cover in a direction substantially perpendicular to that of the movement of approach, while releasing the pulley with respect to the cover.

Thanks to the method of the invention, the positioning of the cover with respect to the actuators makes it possible both to connect the pulleys and the actuators then to release these pulleys in order to allow them to rotate without friction on the cover.

Connection of the pulley and of the corresponding shaft is advantageously effected by clipping.

Finally, the invention relates to a method for dismantling a weave system as described and assembled hereinbefore, in which:

at least one pulley is oriented angularly by transmitting thereto a traction effort exerted by the cord element associated therewith, the cover is displaced in translation in a direction substantially perpendicular to the axis of rotation of the pulley, until this pulley is engaged in a retaining zone made on the cover, and the cover equipped with the pulley is displaced in translation in a direction substantially parallel to the aforementioned axis and in a sense of moving away with respect to the actuator.

At the end of this dismantling, the or each part is maintained angularly in position with a view to a subsequent assembly.

BRIEF DESCRIPTION OF THE DRAWINGS

The invention will be more readily understood and other advantages thereof will appear more clearly in the light of the following description of a form of embodiment of a weave system and of a weaving loom in accordance with its principle, given solely by way of example and made with reference to the accompanying drawings, in which.

DESCRIPTION OF THE PREFERRED EMBODIMENT

Figure 1:
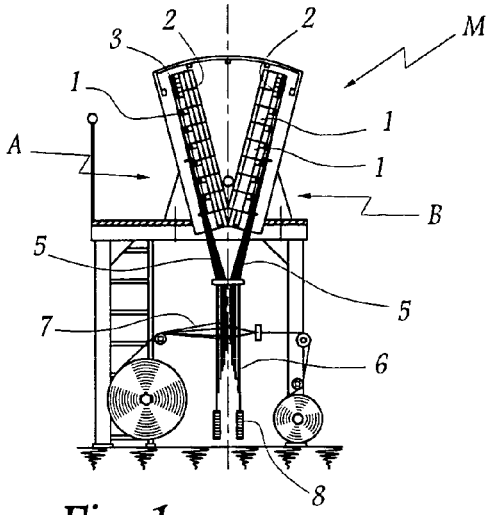
FIG. 1 is a schematic view in vertical section of a weaving loom in accordance with the invention, incorporating a weave system according to the invention.

The weaving loom M shown in FIG. 1 comprises a system formed by the mutual assembling of a plurality of casings 1 of which each contains sixteen electric rotary actuators 2 whose output shaft 3 may bear a pulley 4 for winding a harness cord 5 connected to a heddle 6 intended to control a warp yarn 7 of the loom M and associated with a spring 8 for return into lower position.

The different casings are assembled in rows perpendicular to the plane of FIG. 1 and in columns parallel to this plane. They form two panels A and B disposed above the weaving zone. In a variant, one sole panel formed by casings 1 may be provided. In another variant, the panels A and B may be substantially vertical and parallel to one another.

As is visible in FIG. 2, each casing 1 contains sixteen actuators 2 of which the respective output shafts 3 are parallel and project with respect to the front face 11 of the casing 1.

Figure 6:
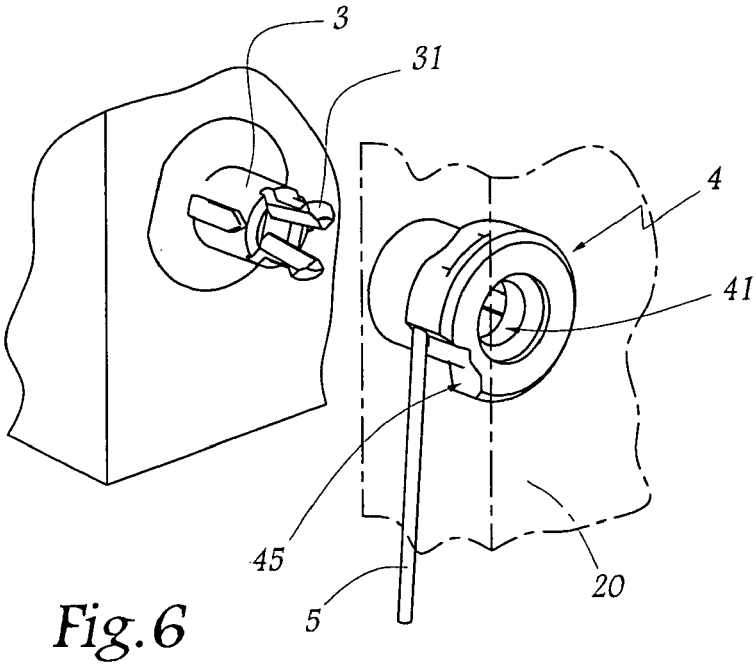
FIG. 6 schematically shows an actuator and a pulley in the course of assembly, the cover being shown in dashed and dotted lines in order to render the drawing clearer.

Each pulley 4 defines a volume 41 for receiving and wedging elastic tabs 31 provided at the end of each shaft 3, this allowing an elastic clipping of a pulley 4 on a shaft 3, in the direction of arrow $F_1$ in FIG. 6.

A cover 20 is provided to be mounted on the front face 11 of the casing 1 jointly with a bar 21 for guiding the harness cords 5.

The cover 20 is configured in order to be able to retain in position the sixteen pulleys 4 intended to be mounted on the actuators 2 of the casing 1.

Figure 3:
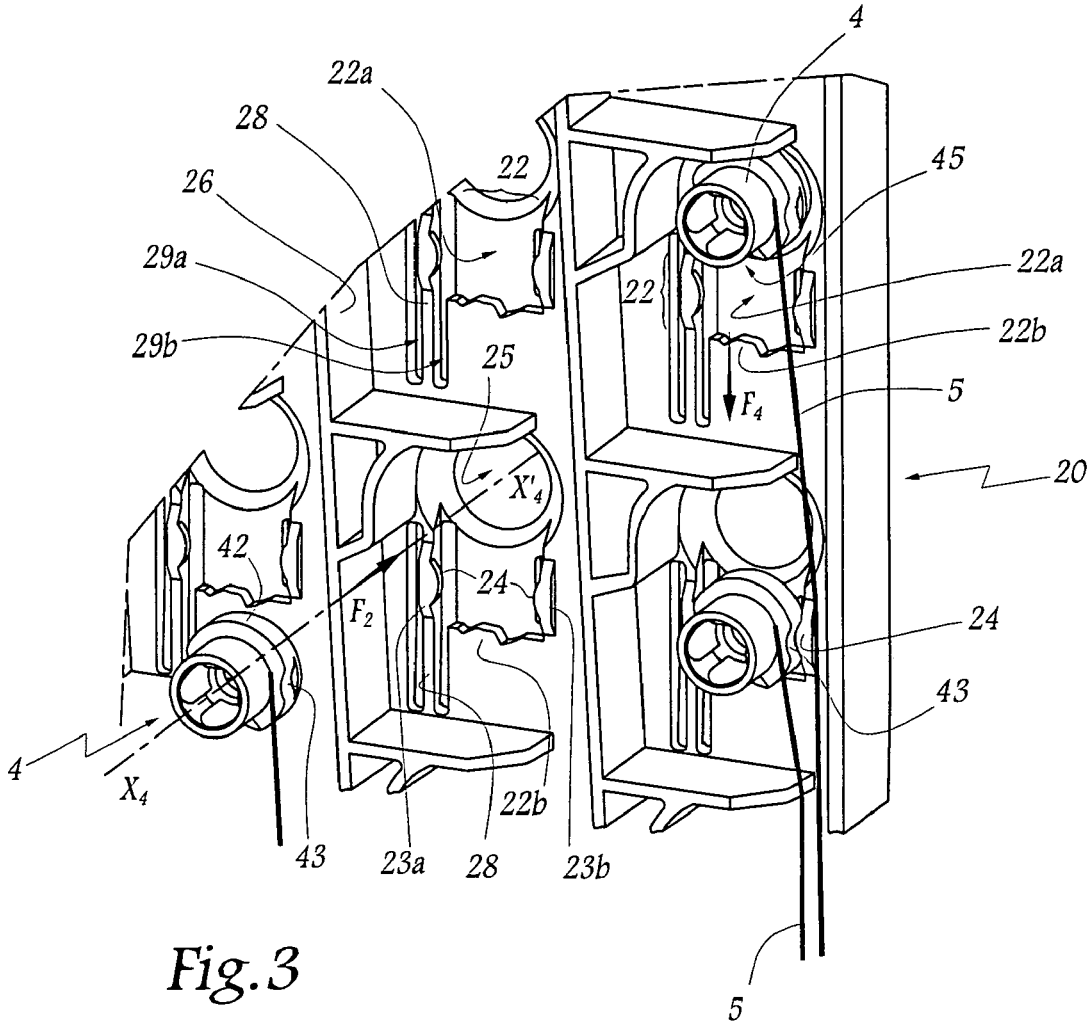
FIG. 3 is a view in perspective, in the direction of arrow $F_3$ of FIG. 2A, of a part of the cover and of three pulleys in different positions corresponding to the assembly of the pulleys on the cover.

As is more particularly visible in FIG. 3, the cover 20 forms a plurality of zones 22 in which the pulleys 4 may be clipped. Each zone 22 is bordered by an elastically deformable tab 23*a* and by a rigid stop 23*b* each provided with a bead 24 oriented towards the centre of the zone 22.

Each pulley 4 is provided, at the level of a flange 42 of larger diameter, with two recesses 43 whose shapes correspond to those of the beads 24.

In the vicinity of each zone 22 and thereabove in the representation of FIG. 3, there are provided zones 25 forming hollow housings of diameter slightly greater than that of the flanges 42, which allows the pulleys 4 to be partially engaged in these housings without being in contact with the cover 20.

The cover 20 is also provided with rigidifying ribs 26 which define individual compartments adapted each to receive a pulley, these compartments communicating with one another to allow passage of the harness cords 5.

The pulleys 4 are assembled on the cover 20 by displacing each pulley towards a zone 25, as represented by arrow-$F_2$ in FIG. 3, this making it possible to attain the position shown in the upper right-hand part of this Figure. It then suffices to exert a downwardly directed vertical effort on the pulley 4, as represented by arrow $F_4$, in order to attain the position of the pulley shown in the lower right-hand corner of FIG. 3 where the tab 23*a* has been elastically deformed in order to allow the introduction between it and the stop 23*b* of the flange 42. The beads 24 then come into engagement in the recesses 43, this allowing an immobilization of each pulley 4 with respect to the cover 20 in a vertical direction.

Figure 4:
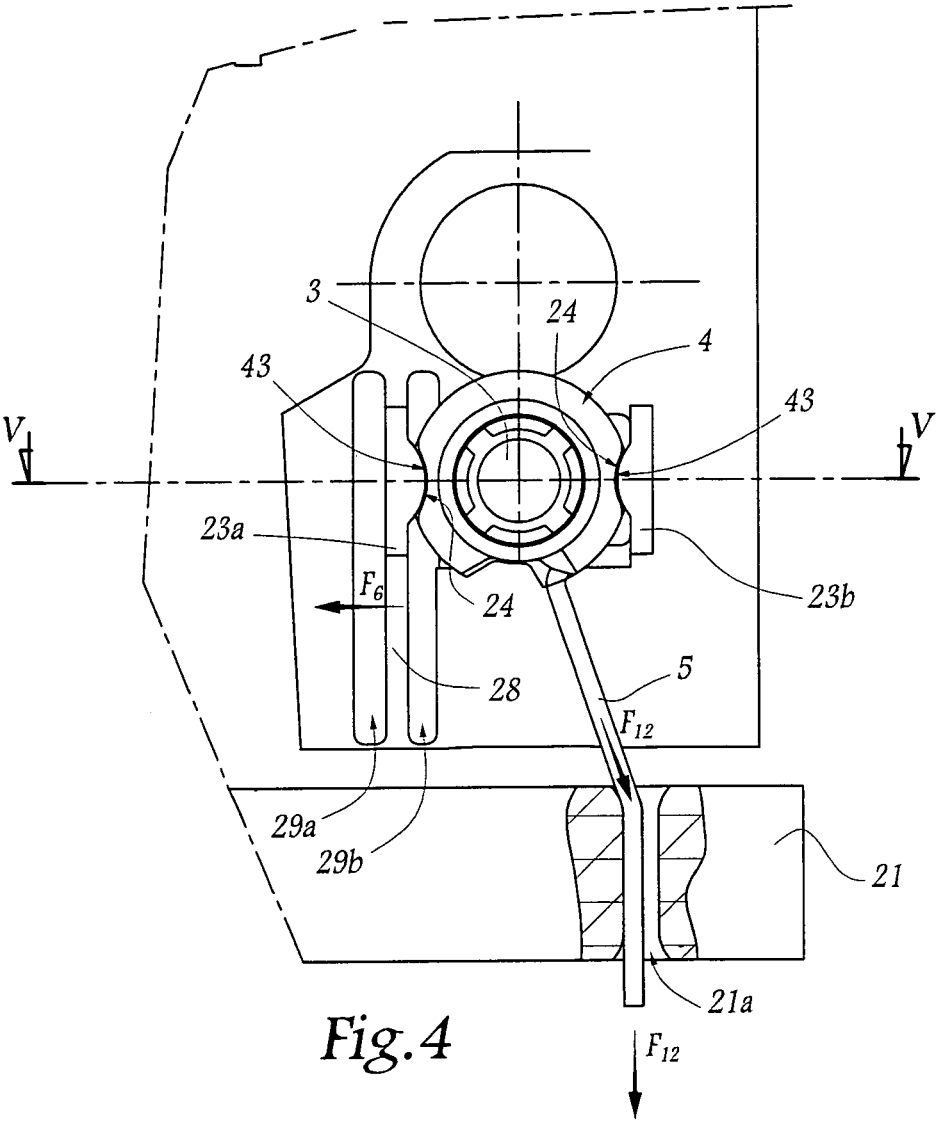
FIG. 4 is a front view of the lower right-hand corner of the cover shown in FIG. 3 and of a part of a yarn-guide bar.

One is then in the position of FIG. 4 where a part 44 of the flange 42 located in the vicinity of each recess 43 is engaged in a zone 27 defined between a bead 24 and the bottom 22*a* of the zone 22.

Figure 5:
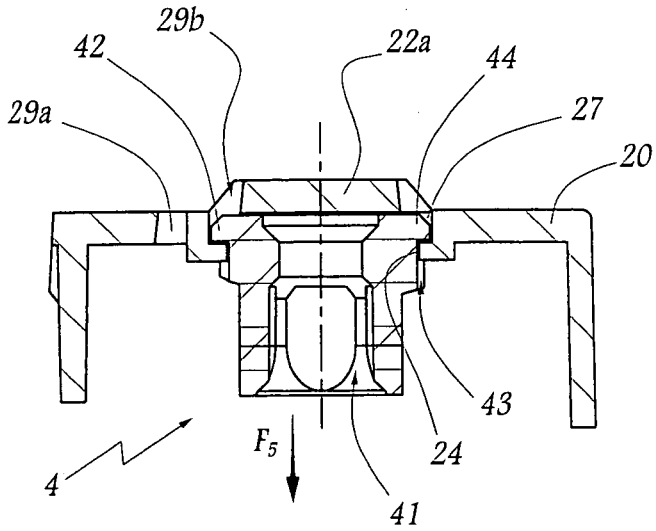
FIG. 5 is a section along line V—V of FIG. 4.

In this way, as is more particularly visible in FIG. 5, the pulley 4 is firmly maintained in position with respect to the cover 20 when the cover is moved in the direction of arrow $F_5$ in this Figure.

It should be noted that the tab 23*a* is in one piece with a tongue 28 defined between two slots 29*a* and 29*b*, which allows a deformation of the elements 23*a* and 28 in the direction of arrow $F_6$ in FIG. 4, thus allowing the pulley 4 to be positioned in the zone 22.

The tab 23*a* and the tongue 28 work in flexion during the movement of introduction of the pulleys 4 in the zones 22 and during the movements of extraction.

According to a variant of the invention (not shown), the two elements 23*a* and 23*b* might be deformable with respect to the rest of the cover 20.

The zone 22 is also bordered by a tooth 22*b* whose shape corresponds approximately to that of a cut-out 45 formed in the flange 42. The cooperation of the elements 22*b* and 45 makes it possible to control the angular orientation of the pulleys 4 about their respective central axes $X_4$–$X'_4$ after assembly on the cover 20.

In this way, the pulleys 4 mounted on the cover 20 may all be substantially in the same angular position about their respective central axes $X_4$–$X'_4$.

There are provided on the cover 20 as many retaining zones 22 as there are actuators 2 in the casing 1. The zones are distributed as a function of the distribution of the actuators in the housing.

When the pulleys 4 are mounted on the cover 20, the different harness cords are passed in the corresponding orifices 21*a* of the bar 21 then the bar 21 and the cover 20 are connected by any appropriate means, for example by introduction of lugs provided in the lower part of the cover 20 in corresponding housings in the bar 21.

The organization in space of the pulleys 4 previously mounted on the cover 20 is in exact register with the organization in space of the actuators 2 in the casing.

Figure 2A:
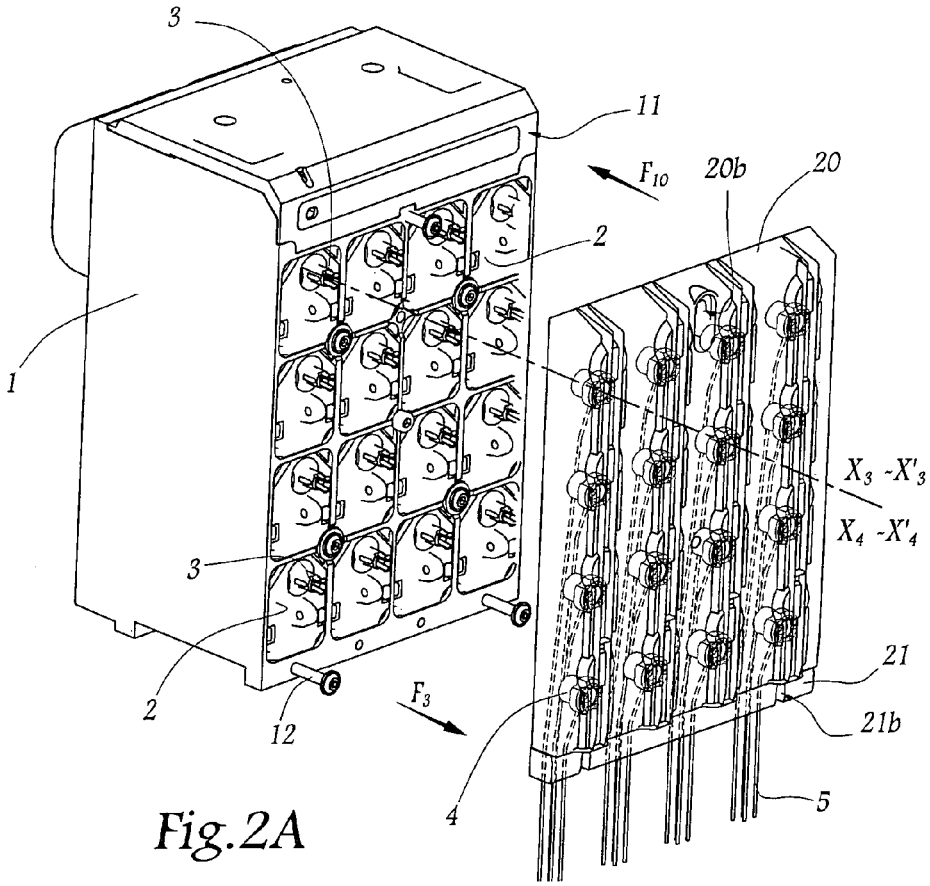
FIGS. 2A, 2B and 2C are views in perspective of a group of actuators belonging to the weave system of FIG. 1 and of an associated cover at different stages of assembly.

The assembly formed by the elements 20 and 21 is then applied on the face 11 of the casing 1 in the direction of arrow $F_{10}$ in FIG. 2A, i.e. in a direction substantially parallel to the central axes $X_3$–$X'_3$ of the shafts 3. The direction of translation of the cover 20 with respect to the casing 1 is likewise parallel to the axes $X_4$–$X'_4$ of the pulleys 4.

At the end of this movement of translation $F_{10}$, the pulleys 4 are automatically clipped on the ends of the shafts 3, by the cooperation of the teeth 31 and of the volumes 41.

Figure 2B:
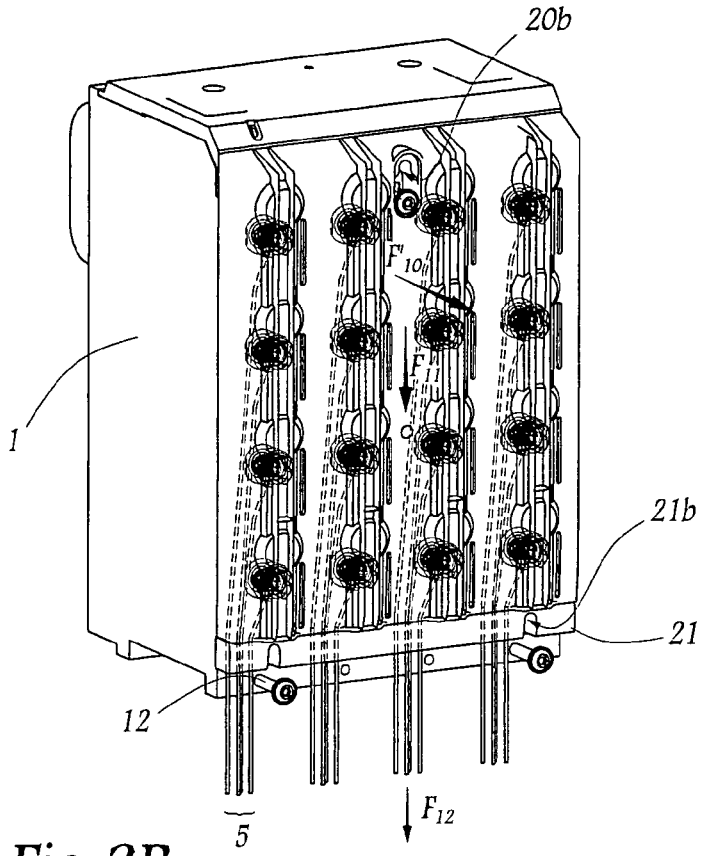

The position of FIG. 2B is then attained, in which screws 12 projecting from the face 11 are respectively engaged in an oblong slot 20*b* in the cover 20 and in notches 21*b* in the bar 21.

It is then possible to subject the cover 20 and the bar 21 to a vertical movement downwardly directed in the direction of arrow $F_{11}$ in FIG. 2B, this having the effect of causing the different pulleys 4 to slide from the zones 22 in which they were previously retained towards the zones 25 in which they may rotate, being driven by the shafts 3, without contact with the cover 20. The position of FIG. 2C is then attained.

In this way, the positioning of the cover 20 and of the bar 21 on the casing 11 allows, in particularly easy manner, the simultaneous catching of the pulleys 4 on the different actuators 2 and their simultaneous release with respect to the cover 20.

Figure 2C:
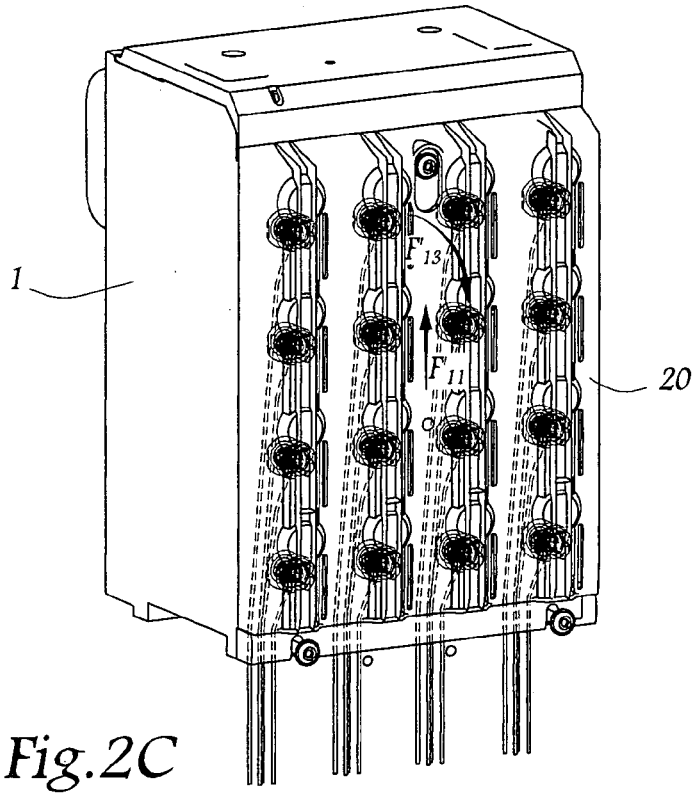

When the different pulleys 4 of the actuators are to be withdrawn from a casing 1, for example with a view to a standard exchange of this casing, the cover 20 is animated by an upwardly directed vertical movement represented by arrow $F'_{11}$ in FIG. 2C, this making it possible to attain the configuration of FIG. 2B again, the different pulleys 4 being again engaged in the zones 22 by this movement. The pulleys 4 are then subjected to a traction effort $F_{12}$ transmitted by the harness cords 5 and resulting from the action of the return springs 8, this participating in their angular orientation, each about its axis $X_4$–$X'_4$. The pulleys are then immobilized in rotation by the cooperation of the elements 24 and 43 which come into engagement. The effort $F_{12}$ therefore makes it possible to obtain a levelling of the angular position of the pulleys 4 at the beginning of dismantling, all the pulleys in that case having the same angular position.

It is then possible to separate the assembly formed by the cover 20 and the bar 21 with respect to the casing 1 by exerting a traction effort in the direction of arrow $F'_{10}$ opposite that of arrow $F_{10}$. As the parts 44 are captive behind the bead 24 of the tabs 23*a* and 23*b*, the pulleys 4 are disconnected from the shafts 3, simultaneously, and the configuration of FIG. 2A is attained again.

It is also possible to dismantle the cover from the configuration of FIG. 2C, leaving the pulleys 4 and the bar 21 in place. To that end, it suffices to loosen the upper screw 12 and to pull on the cover 20 in the direction of arrow $F'_{13}$ in FIG. 2C.

This makes it possible to intervene individually on one or the other of the actuators in order to change the pulley and/or the harness cord associated therewith, and even the whole of the actuator.

What is claimed is:

1. A weaving system of the Jacquard type for forming a shed on a weaving loom, said system comprising; a plurality of electric rotary actuators each engageable to drive in rotation a pulley for winding a cord element that controls a position of at least one heddle, a cover, means to mount said cover to protect a group of said pulleys mounted on a group of adjacent actuators, wherein said cover is provided with retaining means for retaining at least one of said pulleys in a first position relative to said cover as said cover is being moved toward or away from a mounted relationship relative to said group of adjacent ones of said actuators whereby said at least one pulley is simultaneously assembled on or disassembled with respect to a corresponding one of said actuators.

2. The system of claim 1, wherein said retaining means are adapted to retain a plurality of said pulleys in said first position for simultaneous assembly and disassembly with respect to corresponding actuators.

3. The system of claim 1, wherein said retaining means are adapted to retain said at least one pulley in a predetermined angular orientation to thereby facilitate the assembly and disassembly of said at least one pulley with respect to said corresponding actuator.

4. The system of claim 1, wherein said retaining means includes at least one elastically deformable tab defining, with a corresponding member, a zone for receiving a part of said at least one pulley.

5. The system of claim 4, wherein said tab and said member are provided with first elements in relief adapted to cooperate with second elements in relief of corresponding shapes provided on said at least one pulley, the cooperation of said first and second elements in relief inducing an elastic catching of said at least one pulley between said tab and said member.

6. The system of claim 4, wherein said tab and said member define, with a bottom web of said cover, a zone for blocking a part of said at least one pulley.

7. The system of claim 1, wherein said cover includes, in a vicinity of said retaining means, at least one first element in relief adapted to cooperate with a second element in relief of corresponding shape provided on said at least one pulley, the cooperation of said first and second elements in relief inducing a control of an angular orientation of said at least one pulley about a central axis thereof.

8. The system of claim 1, wherein said cover is provided, in a vicinity of said retaining means, with a housing for receiving said at least one pulley without contact so that said at least one pulley is freely rotatable within said cover and said at least one pulley being displaceable with respect to said cover between said first position being retained by said retaining means and a second position, disengaged from said retaining means in which it is positioned in said housing, such displacement being possible due to an elastic deformation of said retaining means.

9. The system of claim 8, including a plurality of pulleys being mountable on a plurality of corresponding actuators wherein said cover is movable, with respect to a casing in which said actuators are mounted, in a direction perpendicular to axes of rotation of output shafts of said actuators, between two positions in which said pulleys are mounted on said actuators and are either in said first position or in said second position.

10. A weaving loom comprising, a weaving system of the Jacquard type for forming a shed on the weaving loom, said weaving system including a plurality of electric rotary actuators each engageable to drive a pulley in rotation for winding a cord element that controls a position of at least one heddle, a cover, means to mount said cover to protect a group of said pulleys mounted on a group of adjacent ones of said actuators, wherein said cover is provided with retaining means for retaining at least one of said pulleys in a first position relative to said cover as said cover is being moved toward or away from a mounted relationship relative to said group of adjacent ones of said actuators whereby said at least one pulley is simultaneously assembled on or disassembled with respect to a corresponding one of said actuators.

11. A method for assembly of a weave system of Jacquard type for forming a shed on a weaving loom, wherein the system includes a plurality of electric rotary actuators adapted each to drive in rotation a pulley for winding a cord element controlling a position of at least one heddle, the method comprising the steps of:

mounting at least one pulley on a cover for isolating and/or protecting the actuators;

bringing the cover and the actuators closer to one another by a movement of translation in a direction substantially parallel to axes of rotation of output shafts of the actuators;

connecting pulley to the output shaft of the corresponding actuator at the end of a movement of approach, and displacing the cover in a direction substantially perpendicular to that of the movement of approach, while releasing the pulley with respect to the cover.

12. The method of claim 11, wherein connection of the pulley and of the shaft is effected by clipping.

13. A method for at least partially dismantling a weave system of Jacquard type for forming a shed on a weaving loom, the system including a plurality of electric rotary actuators adapted each to drive in rotation a pulley for winding a cord element controlling the position of at least one heddle, the method comprising the steps of:

angularly orienting at least one pulley by a traction effort exerted by the cord element associated therewith, displacing a cover for isolating and/or protecting the actuators in translation in a direction substantially perpendicular to an axis of rotation of the pulley, until the pulley is engaged in a retaining zone made on cover, and displacing in translation cover equipped with the pulley in a direction substantially parallel to the axis of rotation and in a motion away with respect to said actuator.

* * * * *